US007201101B2

(12) United States Patent
Oh

(10) Patent No.: US 7,201,101 B2
(45) Date of Patent: Apr. 10, 2007

(54) PUNCH CAPABLE OF PUNCHING AN OBJECT AT FOUR DIRECTIONS

(75) Inventor: Wan-Young Oh, Seoul (KR)

(73) Assignee: DN Craft Corporation, Seoul (KR)

( * ) Notice: Subject to any disclaimer, the term of this patent is extended or adjusted under 35 U.S.C. 154(b) by 299 days.

(21) Appl. No.: 10/887,526

(22) Filed: Jul. 7, 2004

(65) Prior Publication Data

US 2005/0211036 A1 Sep. 29, 2005

(30) Foreign Application Priority Data

Mar. 26, 2004 (KR) ..... 20-2004-0008482

(51) Int. Cl.

| | |
|---|---|
| ***B26F 1/12*** | (2006.01) |
| ***B31F 1/07*** | (2006.01) |
| *B26D 3/14* | (2006.01) |
| *B26F 1/14* | (2006.01) |

(52) U.S. Cl. ..... 101/3.1; 69/2; 83/467.1; 83/588; 83/635; 83/637; 83/685; 83/693; 83/917; 100/94; 100/214

(58) Field of Classification Search ..... 83/467.1, 83/620, 687, 691, 468.1, 549, 588, 618, 621, 83/622, 635, 637, 638, 679, 681–686, 690, 83/692, 693, 698.91, 821, 917; 30/289, 358, 30/359, 366; 69/2; 100/39, 94, 97, 214; 101/3.1, 18, 19, 20

See application file for complete search history.

(56) References Cited

U.S. PATENT DOCUMENTS

| | | | | |
|---|---|---|---|---|
| 2,123,377 | A * | 7/1938 | Papp et al. | 156/386 |
| 2,331,059 | A * | 10/1943 | Tauser | 83/139 |
| 3,026,754 | A * | 3/1962 | Hartup | 83/188 |
| 3,450,037 | A * | 6/1969 | Lickliter et al. | 100/256 |
| 3,568,555 | A * | 3/1971 | Stroh | 83/146 |
| 3,673,902 | A * | 7/1972 | Strobel | 83/133 |
| 4,787,283 | A * | 11/1988 | Foster | 83/453 |
| 4,945,954 | A * | 8/1990 | Wehrly et al. | 140/105 |
| 5,067,242 | A * | 11/1991 | Singer | 30/364 |
| 5,245,904 | A * | 9/1993 | Meyerle | 83/529 |
| 5,495,671 | A * | 3/1996 | Shun-Yi | 30/364 |
| 6,154,942 | A * | 12/2000 | Toeniskoetter | 29/243.58 |
| 6,672,191 | B2 * | 1/2004 | Lin | 83/549 |
| 6,752,058 | B2 * | 6/2004 | Oh | 83/620 |
| 2002/0002891 | A1 * | 1/2002 | Arnold | 83/619 |
| 2004/0169069 | A1 * | 9/2004 | Ostini | 234/109 |

* cited by examiner

*Primary Examiner*—Clark F. Dexter
(74) *Attorney, Agent, or Firm*—Jones Day

(57) ABSTRACT

A punch includes a jig having four punching regions, each punching region having a pattern hole and a concave embossment; guide columns extended upward from a border of the punching regions on the jig; a base for fixing the jig; a punching member punching and embossing the rectangular corner of a sheet member with vertically moving against the jig by guidance of the guide columns; and an elastic body to elastically bias the punching member upward.

5 Claims, 4 Drawing Sheets

PUNCH CAPABLE OF PUNCHING AN OBJECT AT FOUR DIRECTIONS

BACKGROUND OF THE INVENTION

1. Field of the Invention

The present invention relates to a punch for punching a sheet member in a predetermined pattern, and more particularly to a punch capable of allowing easy use and having various kinds of punching patterns since a sheet member may be supplied at four directions when a user punches a rectangular corner of the sheet member such as a card, a letter paper, a picture, a board or a paper.

2. Description of the Related Art

A punch generally includes a jig 10 having a hole 10*a* of a predetermined pattern, a base 20 for supporting the jig 10 below it, and a cutting member 30 having a sharp blade sliding through the hole 10*a* of the jig 10, as schematically shown in FIG. 1. The punch performs punching a specific portion of a sheet member 1 according to the pattern of the hole 10*a* of the jig 10.

In a general punch, a gap is necessarily prepared to the jig 10 for the insertion of a sheet member. To form the gap, the jig 10 is configured so that its side section substantially has a 'U' shape. That is to say, the jig 10 is made to have the hole 10*a* by means of injection molding, and then mechanically cut to form the gap.

However, in the configuration of the above jig, a sheet member may be supplied at most at three directions, but it is impossible to put sheet members and then simultaneously punch or emboss the sheet members in different patterns at four directions. Thus, in order to manufacture a punch which allows supply of sheet members at four directions, there is required a fundamental change in the punch structure.

SUMMARY OF THE INVENTION

The present invention is designed to solve the problems of the prior art, and therefore it is an object of the present invention to provide a punch having a fundamentally improved structure so that sheet members may be supplied at four directions of a jig. According to the present invention, the jig is very convenient to use since punching and/or embossing work may be conducted at four directions, and it is possible to form various kinds of punching patterns by one punch.

In order to accomplish the above object, the present invention provides a punch, which includes a jig having four punching regions radially symmetrical to each other on the basis of a punching center, each punching region having a pattern hole and/or a concave embossment (or, a convex embossment) of a predetermined pattern; a plurality of guide columns respectively extended upward from a border of the punching regions on the jig; a base to which the jig is fixed, the base giving a supply surface so that a rectangular corner of a sheet member to be punched is supplied between the adjacent guide columns; a punching member having a punch pin and/or a convex embossment (or, a concave embossment) corresponding to the pattern hole and/or the concave embossment: (or, the convex embossment), the punching member punching and/or embossing the rectangular corner of the supplied sheet member with moving up and down against the jig by guidance of the guide columns; and an elastic body interposed between the punching member and the jig to elastically bias the punching member upward.

Preferably, elongated guide holes may be formed in the punching member so that the guide columns are combined thereto.

In addition, the punch of the present invention may further include guide units formed on the base in the same radial line as the guide columns so as to guide both edges of the rectangular corner of the supplied sheet member.

The pattern holes formed in four punching regions may be integrated together.

The punch of the present invention may further include a button member combined above the punching member and acting as a contact portion pressed by hand; and a cap for wrapping the button member, the punching member and the elastic body.

According to another aspect of the invention, there is provided a punch, which includes a jig having four punching regions radially symmetrical to each other on the basis of a punching center, each punching region having a pattern hole and/or a concave embossment (or, a convex embossment) of a predetermined pattern; a base to which the jig is fixed, the base giving a supply surface so that a rectangular corner of a sheet member to be punched is supplied to the punching region; a cylindrical support frame mounted on the jig to surround the pattern hole and/or the concave embossment (or, the convex embossment), the support frame having elongated guide holes in an inner circumference thereof so that the elongated guide holes are formed at positions respectively corresponding to borders of the punching regions on the jig; a punching member having a punch pin and/or a convex embossment (or, a concave embossment) corresponding to the pattern hole and/or the concave embossment (or, the convex embossment), the punching member having a plurality of guide columns around a circumference thereof so as to be combined to the elongated guide holes, the punching member punching and/or embossing the rectangular corner of the supplied sheet member with moving up and down against the jig by guidance of the elongated guide holes; and an elastic body interposed between the punching member and the jig to elastically bias the punching member upward.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Figure 1:
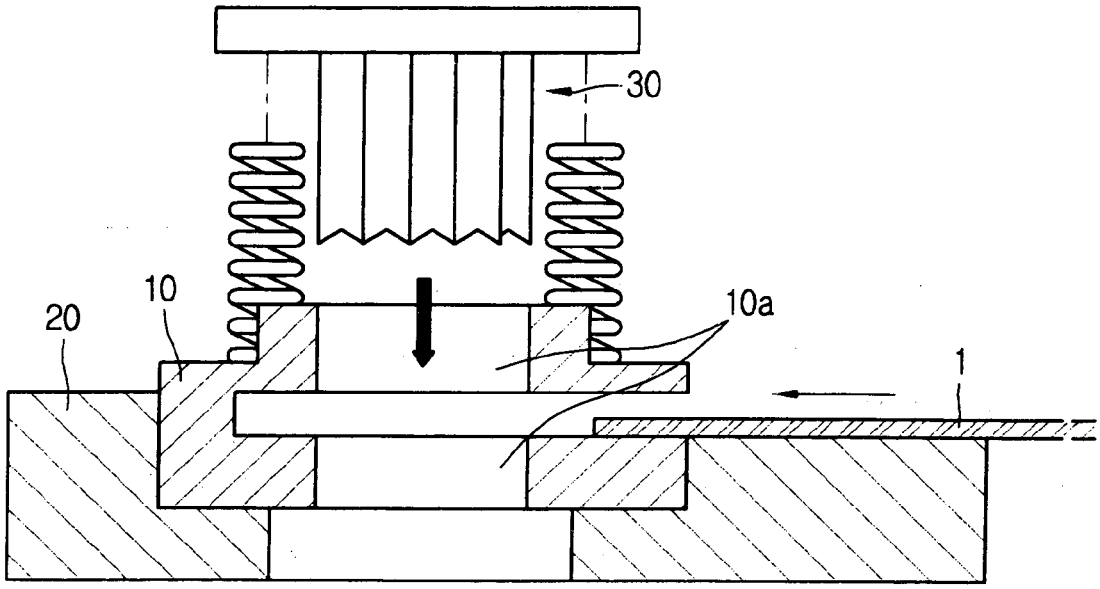
FIG. 1 (PRIOR ART)
FIG. 1 is a sectional view schematically showing a conventional punch.

Hereinafter, the present invention will be described in more detail referring to the drawings.

Figure 2:
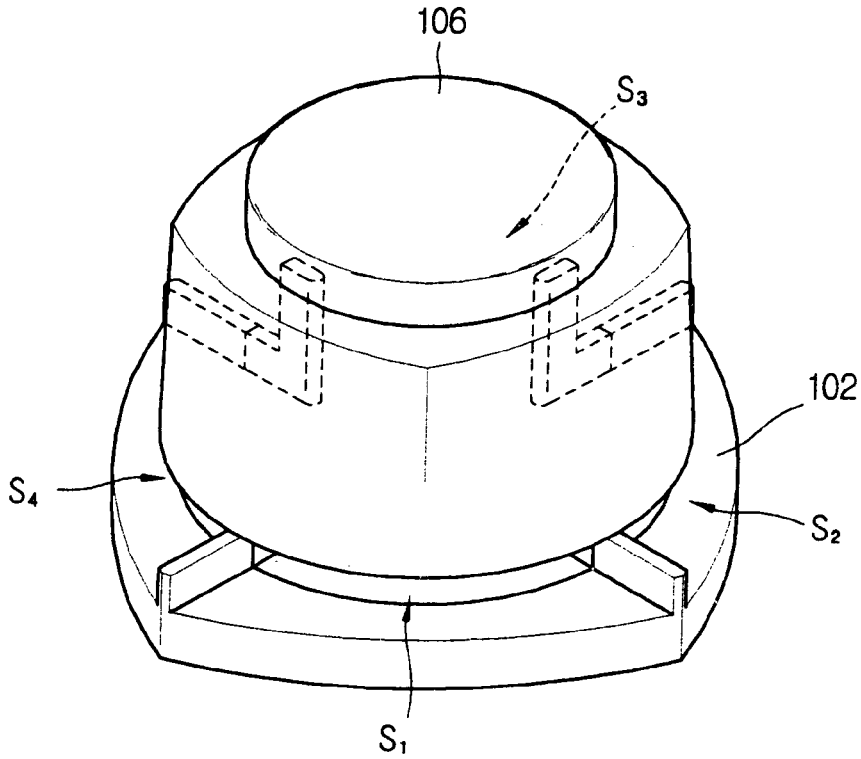
FIG. 2 is a perspective view showing an appearance of a punch according to a preferred embodiment of the present invention.

FIG. 2 shows an appearance of a punch according to a preferred embodiment of the present invention. As shown in FIG. 2, four sheet member supply regions $S_1$, $S_2$, $S_3$ and $S_4$ orthogonal to each other are prepared on a base 102, and a button member 106 is mounted thereto to be movable up and down. According to the punch as mentioned above, various kinds of patterns may be conveniently formed in a sheet member by putting the sheet member in any of the sheet member supply regions $S_1$, $S_2$, $S_3$ and $S_4$ on the base 102, and then pressing the button member 106 downward.

Figure 3:
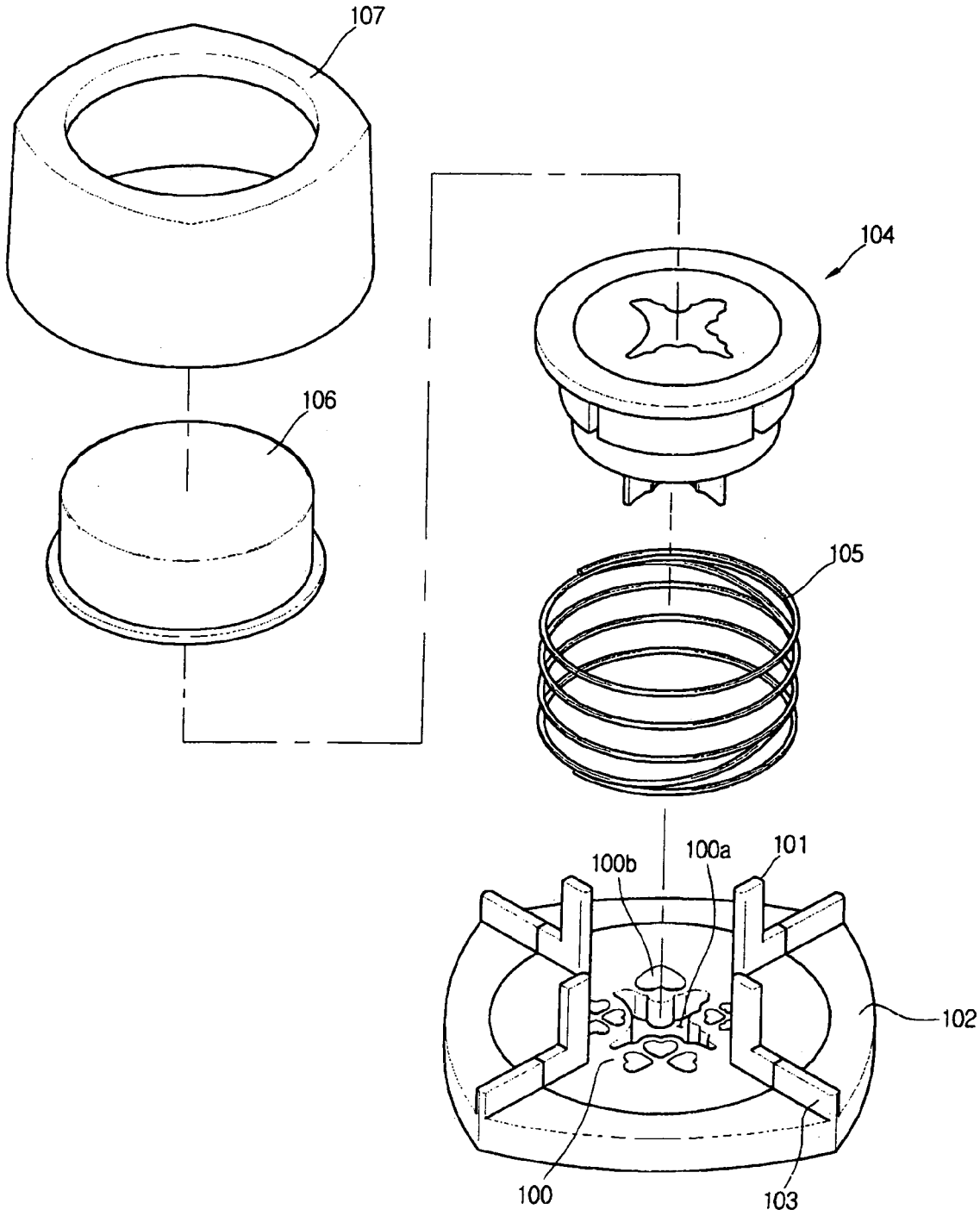
FIG. 3 is an exploded perspective view showing a punch according to a preferred embodiment of the present invention.

FIG. 3 shows the punch according to a preferred embodiment of the present invention in detail.

Referring to FIG. 3, the punch of the present invention includes a jig 100 having a pattern hole 100*a*, a base 102 for supporting the jig 100 and having guide units 103 at four positions, a punching member 104 installed to be movable up and down against the surface of the jig and guided by guide columns 101, and an elastic body 105 for giving an elastic force to the punching member 104.

The jig 100 has four punching regions $P_1$, $P_2$, $P_3$ and $P_4$ radially symmetrical to each other on the basis of a punching center O (see FIG. 5), and a pattern hole 100*a* and/or a convex embossment 100*b* of a predetermined pattern is formed in each punching region $P_1$, $P_2$, $P_3$ or $P_4$.

The pattern hole 100*a* of the jig 100 may be formed integrally, or a plurality of pattern holes may also be formed to be distributed to each sheet member supply region $S_1$, $S_2$, $S_3$ and $S_4$. Here, if the pattern hole 100*a* is integrated, when conducting the four-directional punching work of the present invention, a quarter of the pattern hole 100*a* is used. In this case, quarters of the pattern hole 100*a* may have different shapes.

The base 102 combined below the jig gives a supply surface for supplying a sheet member to be punched. On the surface of the base 102, the guide units 103 are radially mounted for guidance so that a sheet member may be supplied at four directions orthogonal to each other. The guide unit 103 guides the sheet member so that a rectangular corner of the sheet member to be punched is positioned in correspondence to the pattern hole 100*a*. Preferably, the guide units 103 are positioned radially on the basis of the pattern hole 100*a*, and protruded upward at four positions. The guide unit 103 may be variously modified in other ways, for example to have a printed line type.

The punching member 104 is movable up and down against the jig 100, and plays a role of punching and/or embossing a sheet member when it passes through the pattern hole 100*a*.

Figure 4:
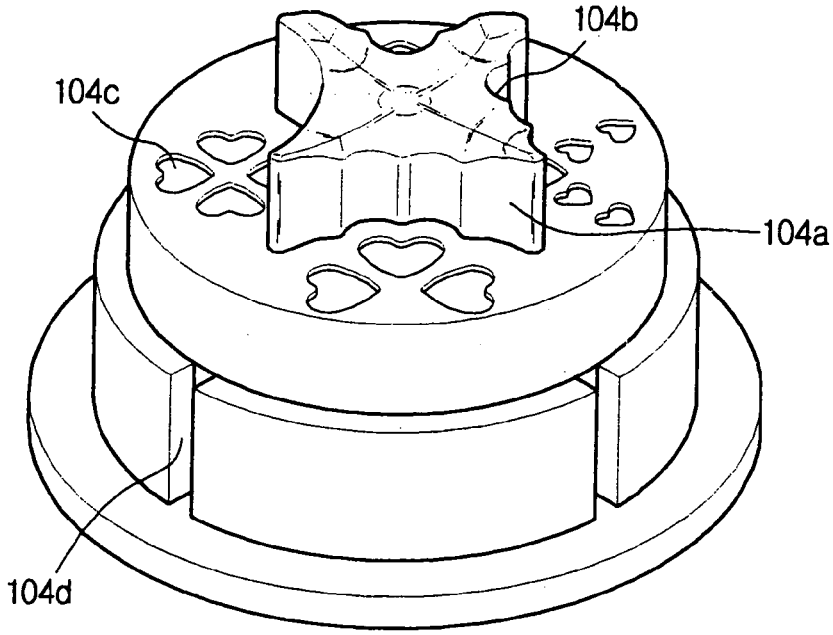
FIG. 4 is a perspective view showing an example of a punching member of FIG. 3.

In order to move the punching member 104 up and down, it is preferable that a plurality of the guide columns 101 are extended upward at borders of the punching regions $P_1$, $P_2$, $P_3$ and $P_4$ on the jig 100 and surrounding the pattern hole 100*a*, and elongated guide holes 104*d* (see FIG. 4) are vertically formed around a body of the punching member 104 so that the guide columns 101 are combined thereto to slide therein.

In addition, the elastic body 105 is interposed between the punching member 104 and the jig 100 and elastically biases the punching member 104 upward so that the punching member 104 is selectively descended toward the jig 100.

According to the above configuration, as the punching member 104 moves up and down by manipulation of a user with being guided by the guide columns 101, the punch pin 104*a* selectively passes through the pattern hole 100*a* of the jig 100. The guide columns 101 substantially surround the pattern hole 100*a* and are formed on the jig 100, but not limited to such configuration. Though not shown in the figures, as another embodiment, the guide columns may be formed along the circumference of the punching member 104, and a predetermined cylindrical support frame having a plurality of elongated guide holes in its inner circumference may be installed on the jig 100 to surround the pattern hole 100*a* so that the guide columns may slide in the elongated guide holes. In this case, the punching member 104 may move up and down against the jig 100 with the guide columns being guided by the elongated guide holes.

In the punching member 104, the punch pin 104*a* having a cutting blade 104*b* corresponding to the pattern hole 100*a* of the jig 100 at its end is protruded downward. The punch pin 104*a* may be formed integrally or as a separated assembly corresponding to the punching region $P_1$, $P_2$, $P_3$ or $P_4$ on the jig 100. Here, if the punch pin 104*a* is formed integrally, only a portion of the cutting blade 104*b* corresponding to an insert direction of the sheet member is concerned in cutting when the four-directional punching work is conducted according to the present invention.

Preferably, in the punching member 104, various kinds of concave embossments 104*c* (see FIG. 4) may be additionally formed on a plane portion around the punch pin 104*a*. Here, the plane portion of the punching member 104 is a portion contacted with the surface of the jig 100 around the pattern hole 100*a* during the punching operation. In this case, a convex embossment 100*b* is formed on the surface of the jig 100 in correspondence to the concave embossment 104*c*. As an alternative, if a convex embossment is formed around the punch pin 104*a* of the punching member 104, a concave embossment may be formed around the pattern hole 100*a* of the jig 100.

The button member 106 is combined above the punching member 104, so the button member 106 presses the punching member 104 down when a user presses it by hand. The button member 106 is covered by a cap 107, which is combined with the base 102 with an open top, so an upper portion of the button member 106 is partially exposed. A rim portion of the button member 106 around the exposed upper portion is supported by the cap 107 so as to prevent the button member 106 from being deviated out due to an elastic force applied to the punching member 104. Here, the cap 107 is combined to the lower base 102 with covering not only the button member 106 but also the punching member and the elastic body below it in a bundle.

Now, operation of the punch configured as above according to the present invention is described.

Figure 5:
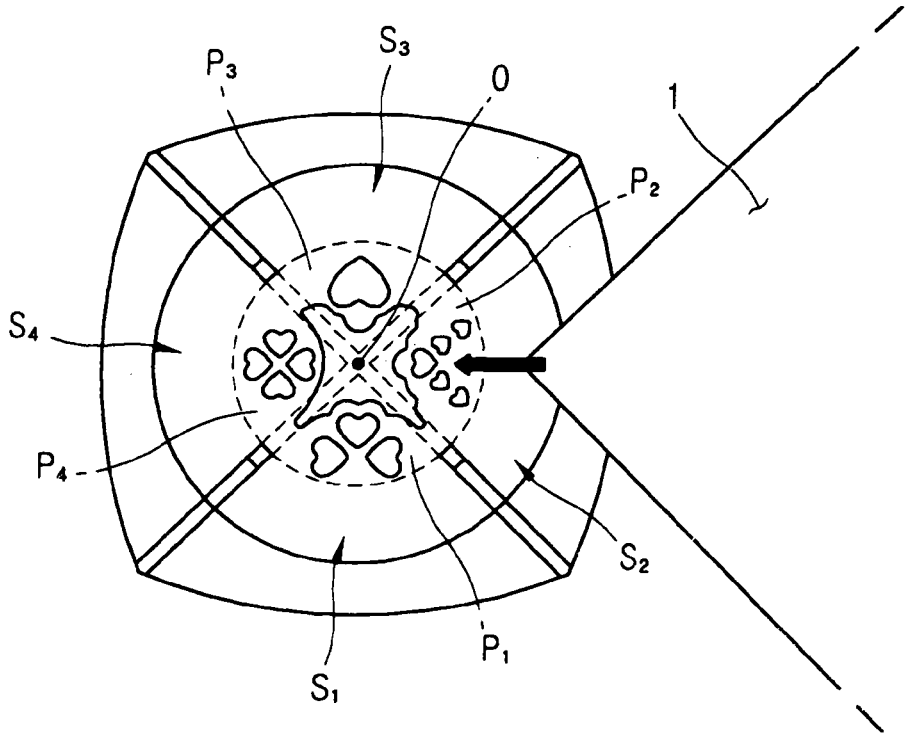
FIG. 5 is a plan view schematically showing that a sheet member is supplied to the punch according to a preferred embodiment of the present invention.

In the punch of the present invention, sheet members may be supplied to any or all of the sheet member supply regions $S_1$, $S_2$, $S_3$ and $S_4$ provided in four portions on the base 102. Here, each border of the sheet member supply regions $S_1$, $S_2$, $S_3$ and $S_4$ is positioned on the same line as the border of the punching regions $P_1$, $P_2$, $P_3$ and $P_4$, and the protruded guide units 103 are preferably provided to the borders. Thus, as shown in FIG. 5, if the sheet member 1 is supplied so that both edges of its corner are guided by two adjacent guide units 103, a rectangular corner of the sheet member 1 may be easily and accurately arranged to the punching region. FIG. 5 shows an example that the sheet member 1 is put in the $P_2$ region among four punching regions $P_1$, $P_2$, $P_3$ and $P_4$.

Figure 6:
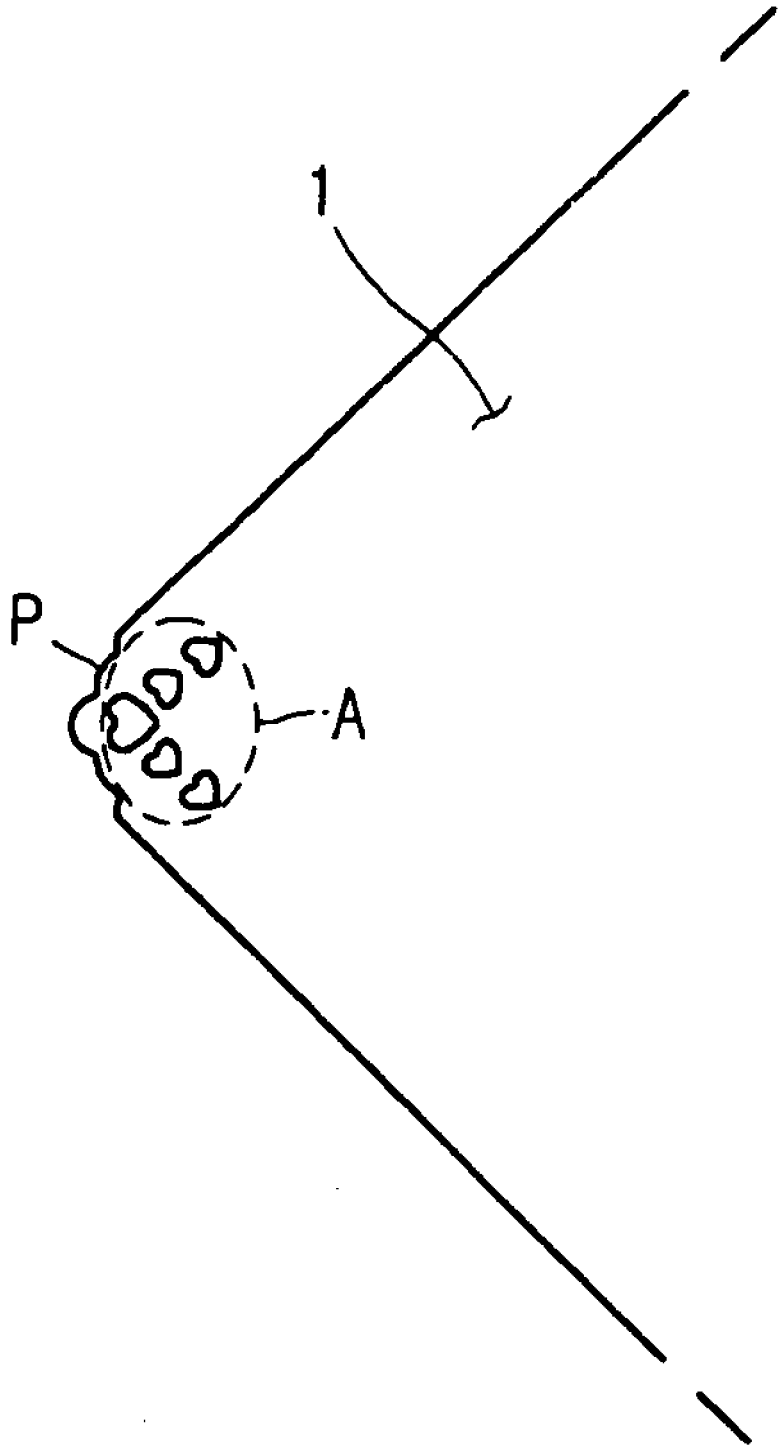
FIG. 6 is a plan view showing that a punching and embossing design is formed in a rectangular corner of a sheet member by the punch according to a preferred embodiment of the present invention.

Then, if a user presses the button member 106 by hand, the punch pin 104*a* of the punching member 104, pressed by the button member 106, descends to pass through the pattern hole 100*a* of the jig 100 with cutting a corresponding area of the sheet member 1. Thus, the sheet member 1 is punched as shown in FIG. 6. Here, if the convex embossment 100*b* is formed around the pattern hole 100*a* and the concave embossment 104*c* corresponding to the convex embossment 100*b* is formed around the punch pin 104*a*, both embossments are compressed to each other with a corresponding area of the sheet member 1 being interposed therebetween, so an embossing pattern A is formed in the sheet member at a position adjacent to the punching pattern P.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

APPLICABILITY TO THE INDUSTRY

The punch according to the present invention is very convenient to use since a sheet member may be supplied at four directions of the jig, and various kinds of punching patterns may be formed by only one punch.

In addition, the punch of the present invention may punch and emboss the rectangular corner of the sheet member at the same time, thereby giving excellent decoration effects.

This punch may be used for accurately forming various punching and embossing patterns in a corner portion of a sheet member such as a card, a letter paper, a picture, a board, or a paper, which requires decoration, as well as for punching work in offices or industries.

In addition, though the conventional 'U'-shaped jig having a pattern hole is large and heavy since the pattern hole guides a punch pin to slide therethrough, a jig block in the punch of the present invention may be relatively simplified since the punching member is guided by means of combination of the guide columns and the elongated guide holes. Moreover, the jig of the punch of the present invention does not require a precise cutting process to form a gap, thereby improving the production efficiency.

What is claimed is:

1. A punch comprising:

a jig having four punching regions radially symmetrical to each other on the basis of a punching center, each region separated from adjacent regions by a border, and a pattern hole of a predetermined pattern formed on the jig and disposed in the four punching regions;

a guide column extended upward from each of the borders of the punching regions on the jig, each of the guide columns having a guide surface on opposite sides thereof, each of the guide surfaces extending substantially linearly in a substantially radial direction toward the punching center for guiding an edge of a supplied sheet member;

a base to which the jig is fixed, the base providing a supply surface so that a rectangular corner of the sheet member to be punched is supplied between the adjacent guide columns;

a punching member having a punch pin corresponding to the pattern hole, the punch pin cooperating with the pattern hole to punch the rectangular corner of the supplied sheet member with moving up and down of the punching member relative to the jig, the punching member guided by the guide columns, wherein elongated guide holes are formed in the punching member so that the guide columns cooperate therewith; and an elastic body interposed between the punching member and the jig to elastically bias the punching member upward.

2. A punch according to claim 1, further comprising guide units formed on the base in the same radial line as the guide columns so as to guide both edges of the rectangular corner of the supplied sheet member.

3. A punch according to claim 1, further comprising:

a button member disposed above the punching member and acting as a contact portion to be pressed by hand; and a cap substantially surrounding the button member, the punching member and the elastic body.

4. The punch of claim 1, wherein at least one punching region of the jig further comprises an embossment.

5. The punch of claim 1, wherein the punching member further comprises an embossment.

* * * * *